US005724713A

United States Patent [19]

Holtz

[11] Patent Number: 5,724,713

[45] Date of Patent: Mar. 10, 1998

[54] METHOD OF ERECTING AN INTERNALLY SUPPORTED GARMENT BAG

[76] Inventor: Gilbert J. Holtz, 182 Tibbetts Rd., Yonkers, N.Y. 10705

[21] Appl. No.: 610,485

[22] Filed: Mar. 4, 1996

[51] Int. Cl.[6] ..... B21D 39/00

[52] U.S. Cl. ..... 29/452

[58] Field of Search ..... 29/452; 312/265.1, 312/3, 6, 257.1, 265.4; 135/909, 900, 901, 128, 114, 115; 211/182, 189; 493/935

[56] References Cited

U.S. PATENT DOCUMENTS 1,033,630 7/1912 Sowers ..... 312/3

2,517,757 8/1950 Adlerstein ..... 312/3

4,026,312 5/1977 Beavers ..... 135/909

*Primary Examiner*—Carl E. Hall

*Assistant Examiner*—Christopher Goins

*Attorney, Agent, or Firm*—Myron Amer, P.C.

[57] ABSTRACT

An internally supported and ready-to-use erect garment bag having in its front panel a T-shaped configuration of two horizontally oriented zippers and a third vertically oriented zipper wherein the opening of all zippers provides a large-sized opening facilitating the fitting loosely of the garment bag upon its internal support, the closing of the two horizontal zippers makes the fit taut, and the third zipper provides ready access into and closes off the garment bag clothes-storage compartment.

1 Claim, 4 Drawing Sheets

METHOD OF ERECTING AN INTERNALLY SUPPORTED GARMENT BAG

The present invention relates generally to internally supported three-dimensional or erect garment bags for clothes storage and the like, and more particularly to improvements in the use and in the preparation for use of such garment bags.

EXAMPLES OF THE PRIOR ART

Garment bags for clothes storage of the type internally supported to bound in their erect or three-dimensional condition a clothes storage compartment are already well known, as exemplified by the two French patents 1,381,948 issued to Plastra in February 1964 and 1,445,789 issued to Poirier in June 1965, wherein there is disclosed and illustrated a garment bag of fabric or like construction material in covering relation over an internal construction of interfitting members which hold the panels of the garment bag apart from each other to bound therebetween the clothes storage compartment so that clothes stored therein are not soiled, do not create an unsightly appearance and other such reasons. Access into and the closing off of the storage compartment is through an opening in a front panel of the garment bag. The prevalent practice, as exemplified by the garment bags of the noted French patents is also to use the front panel opening for access into the interior of the garment bag in the construction of its internal support. Stated otherwise, the internal support is constructed within the confines of the garment bag and this, presumably is because it is too difficult to first erect the support and afterwards try to insert it into the interior of the garment bag or alternatively to try to maneuver the garment bag into covering relation over the already-erected support.

Broadly, it is an object of the present invention to provide an internally supported garment bag overcoming the foregoing and other shortcomings of the prior art.

More particularly, it is an object to provide a method of preparing a garment bag for use in which the user can attend initially to the construction of what is ultimately used to support the garment bag without working in the cramped confines of the garment bag, and afterwards in a significantly enhanced manner readily fit the garment bag over the erected support, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 2:
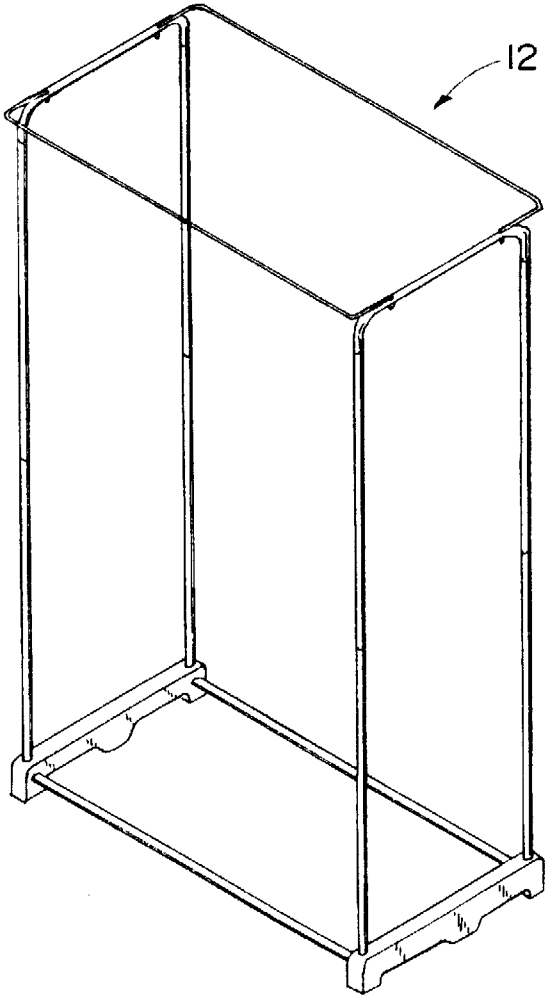
FIG. 2 is a view similar to FIG. 1 but showing the internal support components assembled to each other.
Figure 7:
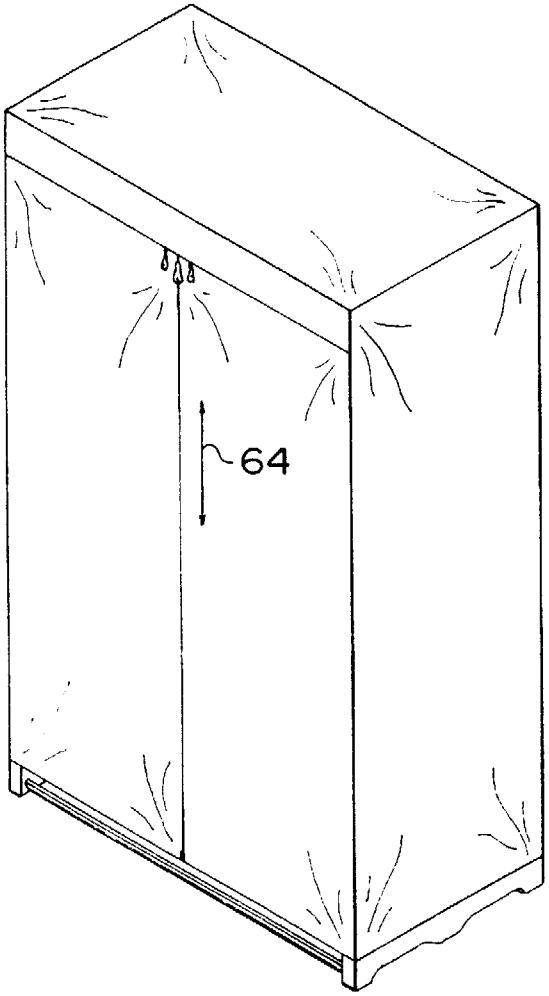
FIG. 7 is a perspective view of the internally supported garment bag in its intended condition for end use.

Already well-known, as exemplified by that illustrated in FIG. 7, are articles of manufacture consisting of an external garment bag 10 supported in a three-dimensional configuration upon an internal support 12 (FIG. 2). What is not known and what is unique about the internally supported garment bag assembly 10, 12 of FIG. 7 is the facilitated manner in which it is assembled ready for its intended use for storage of clothing and like items, all as will be better understood as the description proceeds.

Figure 1:
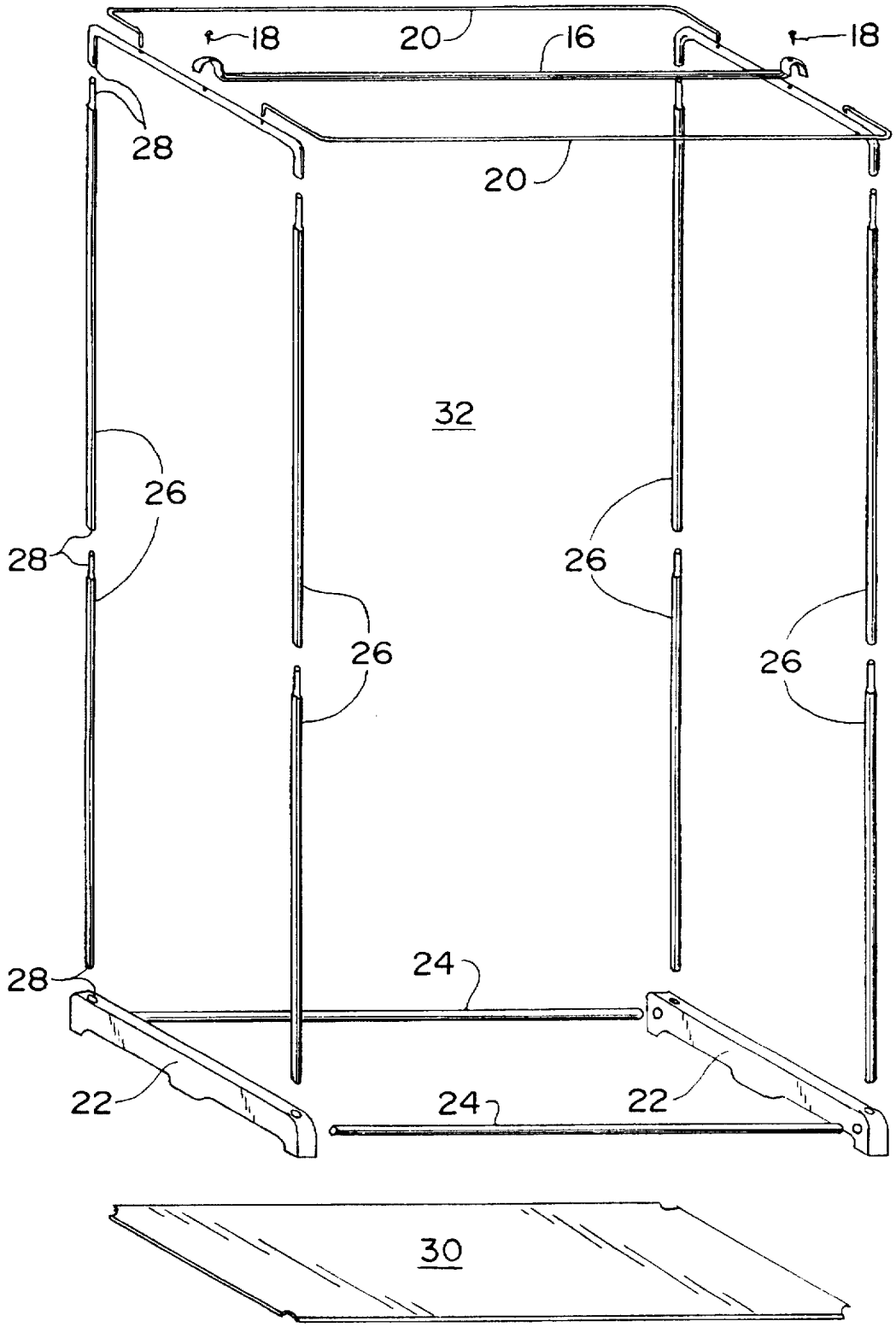
FIG. 1 is a perspective view of the components of an internal support of the within garment bag shown in unassembled relation.

The construction and assembly of the internal support 12, as best understood from progressive reference to FIG. 1 and 2, includes use of a rectangular top formed by opposite side support members 14, a medially located cross support member 16 secured in place with screws 18, and wire members 20 imparting a rectangular shape to the top. At the internal support opposite end use is made of a rectangular bottom formed by opposite side base support members 22 and opposite cross support rods 24. The aforesaid top and bottom are held in spaced superposed relation by pairs of interconnected rods, individually and collectively designated 26, which at opposite ends at the corner intersections with the top and bottom and at intermediate locations have appropriate male and female connection means, also individually and collectively designated 28. Completing the assembly of the support members or components of the internal support 12 depicted in FIG. 1 into the condition ready for use as depicted in FIG. 2 is an appropriately sized and shaped bottom panel 30 as shown in FIG. 1 (and omitted in FIG. 2 to facilitate an understanding of the assembly of the bottom 22, 24).

As understood, the three-dimensional construction of FIG. 2 bounds a clothes-storage compartment 32 which, however, to obviate soiling the stored clothes, masking an unsightly appearance of the stored clothes, and other like reasons, requires the external garment bag 10 to be disposed in covering relation over the already assembled three-dimensional support of FIG. 2.

The within garment bag 10 is specifically suited for assembly to its internal support 12 as will now be explained. More particularly, garment bag 10 is preferably of vinyl plastic construction material fabricated by known heat-sealing techniques or, alternately if of fabric construction material fabricated by known sewing techniques, into a configuration having a front panel 34, opposite side panels 36, a back panel 37, and a top panel 38, the shape of which configuration is similarly rectangular as is that of its internal support of FIG. 2, and the size of which configuration is selected to be slightly oversized with respect to the size of the internal support 12.

In the garment bag front panel 34 in a T-shaped configuration are two horizontally oriented first and second zippers 40 and 42 adjacent and just below the top edge of the top panel 38, and a third vertically oriented zipper 44 located centrally of the front panel 34 and at its upper end intersecting, as at 46, the meeting site of the zipper pulls 48 and 50 of zippers 40 and 42.

Figure 3:
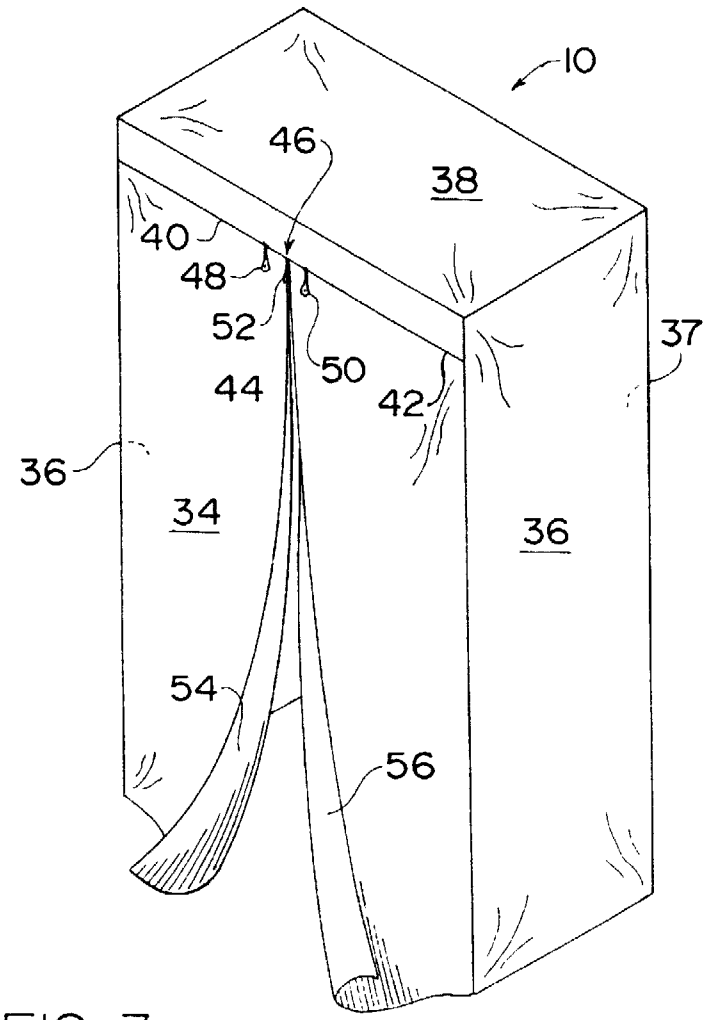
FIG. 3 is a perspective isolated view of the garment bag in an initial condition preparatory to being disposed in assembled relation to the assembled support components of FIG. 2.
Figure 4:
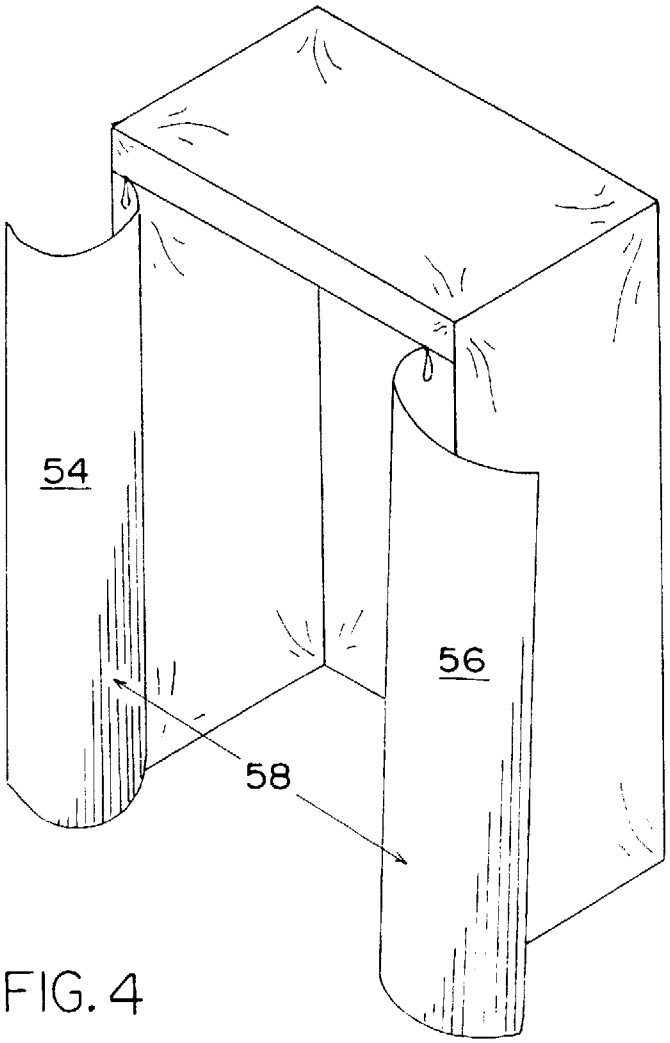
FIG. 4 is a view similar to FIG. 3 but illustrating the garment bag in a subsequent condition of preparation.

Preparatory to the fitting or assembly of the garment bag 10 upon its internal support 12, the zipper pull 52 is urged through ascending movement and up to the zipper site 46, thus configurating front panel 34 preliminarily into two flaps 54 and 56 (FIG. 3) and subsequently the zipper pulls 48 and 50 are urged from the zipper site 46 in opposite lateral or horizontally oriented directions which completes the delineation in front panel 34 of the flaps 54 and 56 and, more importantly, the provision of the enlarged opening 58 bounded between the rearwardly folded back flaps 54 and 56 (FIG. 4).

Figure 5:
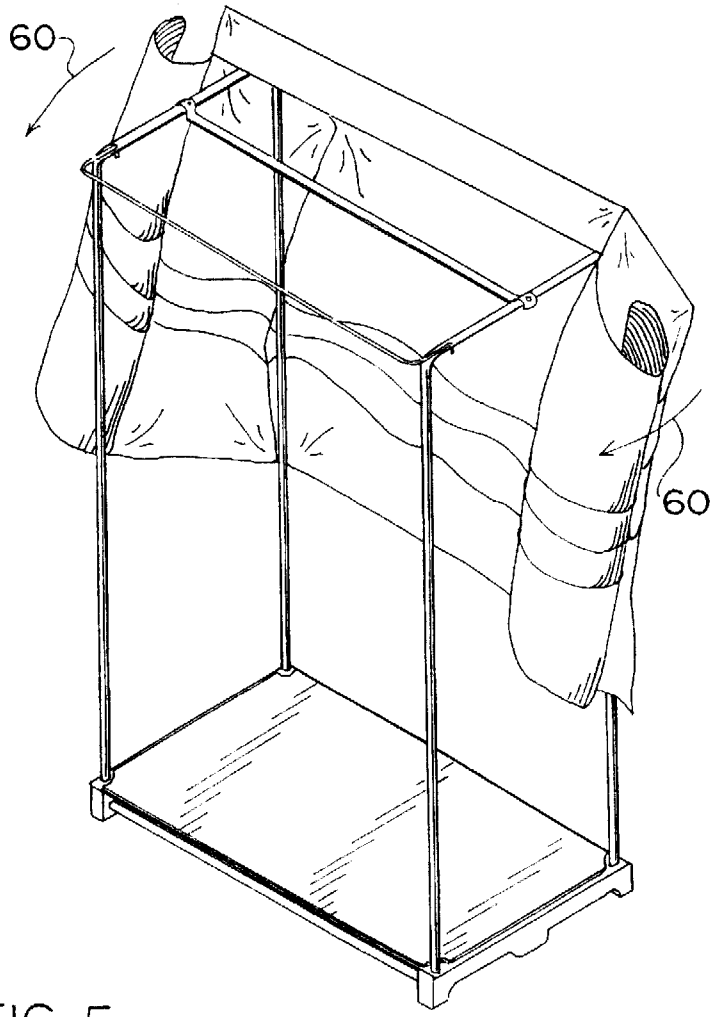
FIG. 5 is a perspective view illustrating the assembly of the garment bag in its condition of preparation of FIG. 4 upon the assembled support components of FIG. 2.

Using to advantage the large-sized front panel opening 58, the garment bag 10 is easily positioned to receive in projected relation therein the top of the internal support 12 and the flaps 54 and 56 then wrapped in circumferential relation, as denoted by the arrows 60, about the opposite internal support sides into a position forward of the front of the internal support 12, as is illustrated and is readily surmised from FIG. 5.

Figure 6:
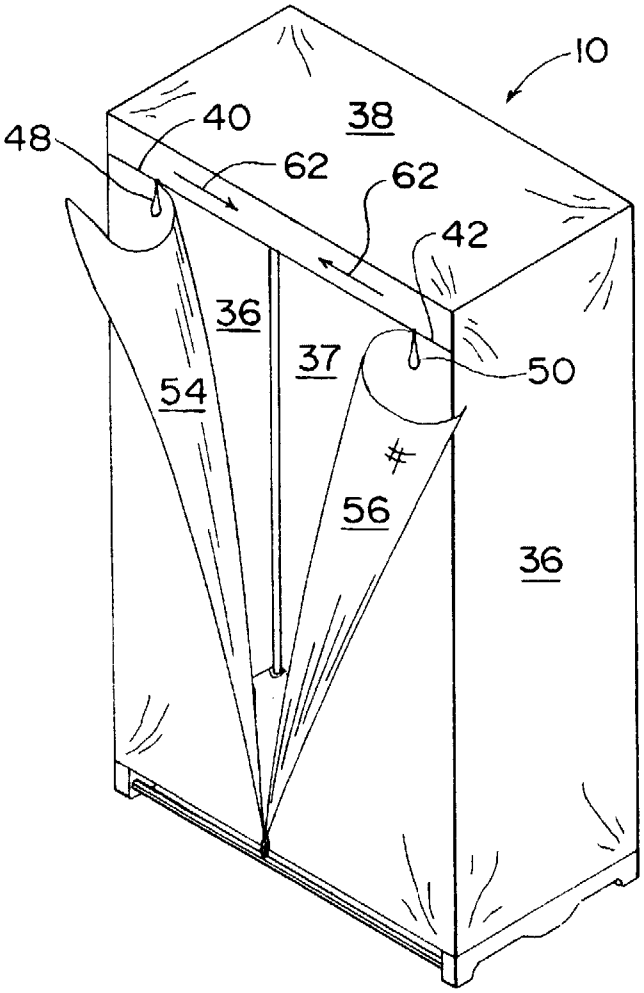
FIG. 6 is a perspective view illustrating the completion of the assembly process of garment bag and internal support depicted in FIG. 5.

Next, as is readily understood from FIG. 6, the open two zippers 40 and 42 are closed, as by movement of the zipper pulls 48 and 50 in the directions 62, which contributes to providing the garment bag 10 with a taut fit upon the internal support 12, the extent of the tautness being a function of the selected oversize of the garment bag 10 to the size of the internal support 12 and is a manufacturing specification well within the expertise of internally supported garment bag manufacturers.

The primary utility of the two zippers 40 and 42 are in the fitting of the garment bag 10 upon its internal support 12 and thus, after serving this need, these zippers are left in their closed condition and the zipper pull 52 of zipper 44 is alternately urged through ascending and descending movement 64 to gain access to and to close off the clothes storage compartment 32, it being noted that the closed condition of the two zippers 40 and 42 retains the desired tautness in the fit of the garment bag 10 upon its internal support 12 even in the open condition of the third zipper 44.

In a preferred embodiment, in an erect condition, the internal support 12 provides a three-dimensional configuration which is 60 inches high, 22 inches deep, and 36 inches wide.

While the garment bag-erecting method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. In a method of erecting an internally supported garment bag having front, rear, top and opposite side panels cooperating to bound a garment storage compartment characterized by a T-shaped configuration of two horizontally oriented first and second zippers and a third vertically oriented zipper in said garment front panel to provide an opening in said front panel incident to positioning said garment bag on an internal support, a garment bag-erecting method comprising the steps of interconnecting cooperating support components into a three-dimensional construction for occupancy within said garment storage compartment of said garment bag, urging in movement in laterally opposite directions from a site of meeting along paths of movement adjacent an upper edge of said garment bag front panel zipper pull means of said first and second zippers incident to providing detached upper edges in parallel relation to bottom edges of said front panel on opposite sides of rectangular flaps in said garment front panel, urging in ascending movement along a path centrally of said garment bag front panel up to a site of meeting of said first and second zippers a zipper pull means of said third zipper incident to releasing said rectangular flaps from said garment bag front panel which rectangular flaps bound a large-sized front panel opening therebetween, positioning said garment bag top panel in covering relation over a top of said three-dimensional construction incident to projecting a top of said three-dimensional construction through said large-sized front panel opening, wrapping in circumferential relation said rectangular flaps about opposite sides of said three-dimensional construction and into a position forward of a front of said three-dimensional construction to contribute to placement of said garment bag in supported relation upon said three-dimensional construction, urging said zipper pull means of said first and second zippers in closing movement towards each other to contribute to a taut fit of said garment bag upon said three-dimensional construction, and urging alternately said zipper pull means of said third zipper in ascending and descending movement to close and open said garment storage compartment, whereby said three-zipper operating mode facilitates use and preparation for use of said garment bag.

* * * * *